US005833809A

United States Patent [19]

Odell

[11] Patent Number: 5,833,809

[45] Date of Patent: Nov. 10, 1998

[54] TWIN-WIRE FORMER

[75] Inventor: Michael Odell, Jyväskylä, Finland

[73] Assignee: Valmet Corporation, Helsinki, Finland

[21] Appl. No.: 518,793

[22] Filed: Aug. 23, 1995

[30] Foreign Application Priority Data

Aug. 31, 1994 [FI] Finland ..... 943987

[51] Int. Cl.[6] ..... D21F 1/00

[52] U.S. Cl. ..... 162/203; 162/217; 162/300; 162/301

[58] Field of Search ..... 162/203, 217, 162/300, 301, 352

[56] References Cited

U.S. PATENT DOCUMENTS

| | | | |
|---|---|---|---|
| 3,876,499 | 4/1975 | Vesanto | 162/301 |
| 4,532,008 | 7/1985 | Creagan et al. | 162/301 |
| 4,790,909 | 12/1988 | Harwood | 162/301 |
| 4,908,102 | 3/1990 | Zag et al. | 162/264 |
| 4,925,531 | 5/1990 | Koski | 162/301 |
| 5,019,214 | 5/1991 | Meinecke et al. | 162/301 |
| 5,074,966 | 12/1991 | Koivuranta | 162/301 |
| 5,167,770 | 12/1992 | Bubik et al. | 162/301 |
| 5,215,628 | 6/1993 | Kolvuranta et al. | 162/301 |
| 5,259,929 | 11/1993 | Bubik et al. | 162/301 |
| 5,395,484 | 3/1995 | Odell et al. | 162/203 |

FOREIGN PATENT DOCUMENTS

| | | | |
|---|---|---|---|
| 0300547 | 1/1989 | European Pat. Off. . | |
| 454989 | 11/1991 | European Pat. Off. | 162/301 |
| 0475921 | 3/1992 | European Pat. Off. . | |
| 90572 | 3/1989 | Finland . | |
| 84637 | 6/1990 | Finland . | |
| 885607 | 6/1990 | Finland . | |
| 920228 | 1/1992 | Finland . | |
| 91788 | 3/1992 | Finland . | |
| 905447 | 5/1992 | Finland . | |
| 924289 | 9/1992 | Finland . | |
| 88057 | 12/1992 | Finland . | |
| 930927 | 3/1993 | Finland . | |
| 931951 | 4/1993 | Finland . | |
| 932265 | 5/1993 | Finland . | |
| 934999 | 11/1993 | Finland . | |
| 91092 | 1/1994 | Finland . | |
| 91173 | 2/1994 | Finland . | |
| 92940 | 10/1994 | Finland . | |
| 4208681 | 9/1993 | Germany . | |

*Primary Examiner*—Karen M. Hastings
*Attorney, Agent, or Firm*—Steinberg, Raskin & Davidson, P.C.

[57] ABSTRACT

A twin-wire former of a paper machine, for high speed paper machines whose web running speed is of an order of from about 1600 m/min to about 2500 m/min. The former includes a carrying wire guided in a loop and a covering wire guided in a loop to define a twin-wire zone and an inlet or forming gap between the wires. A pulp suspension layer or a pulp suspension jet is fed into the inlet or forming gap through a discharge duct of a headbox. The former also includes, as a combination, a first forming-suction roll arranged proximate the forming gap in a loop of one of the wires and a second forming-suction roll arranged inside the loop of the wire opposite to the wire inside whose loop the first forming roll is arranged. The forming-suction rolls have suction zones over which the twin-wire zone is curved on certain sectors. In the suction zones, the vacuum levels are arranged adjustable independently from one another, and possibly relative to one another, so as to minimize the unequalsidedness of the web. After the second forming-suction roll, there is a pressure pulsation unit in the twin-wire zone.

19 Claims, 5 Drawing Sheets

TWIN-WIRE FORMER

FIELD OF THE INVENTION

The present invention relates to a twin-wire former of a paper machine, in particular for high-speed paper machines in which the running speed of the web is from about 1600 m/min to about 2500 m/min (meters per minute). The inventive former comprises a carrying wire guided in a loop and a covering wire guided in a loop, which wires define a twin-wire zone and an inlet or forming gap therebetween. A pulp suspension layer or a pulp suspension jet is fed into the inlet or forming gap through a discharge duct of a headbox and is then carried through the twin-wire zone. The present invention also relates to a method for dewatering a web in a twin-wire former of a paper machine to minimize unequalsidedness of the web.

BACKGROUND OF THE INVENTION

In web formers of paper machines, a number of different forming members are used. The primary function of these forming members is to produce a compression pressure and pressure pulsation in the fiber layer that is being formed since by means of the pressure and pulsation, draining of water out of the web that is being formed is promoted and, at the same time, the formation of the web is improved. Such forming members include different forming shoes which are usually provided with a curved ribbed deck and over which the forming wires placed one above the other and the web placed between them are curved. In the areas of these forming shoes, water is drained through the wire placed at the side of the outside curve because of the tensioning pressure of the wire. This draining is aided further by a field of centrifugal force. Draining also takes place through the wire placed at the side of the inside curve, which draining is typically intensified by the negative pressure present in a chamber of the forming shoe. The ribbed deck of the forming shoe produces pressure pulsation which both promotes the dewatering and improves the formation of the web.

Further, in the prior art, so-called MB units are known, through which two wires run as a straight or curved run and which wires are placed one opposite to the other. In the prior art MB units, there is a pressure loading unit arranged inside the loop of one of the wires, and inside the loop of the other, opposite wire, a draining unit is arranged which is provided with a set of guide and dewatering ribs. As known in the prior art, the MB unit is generally placed on the Fourdrinier wire part so that the MB unit is preceded by a single-wire portion of considerable length, in which a substantial proportion of draining of water takes place before the web runs as a straight run in the plane of the Fourdrinier wire through the MB unit. With respect to the details of construction of the prior art MB units, reference is made, by way of example, to the assignee's Finnish Patent Application Nos. 884109 and 885607.

In the prior art, a number of different hybrid formers and twin-wire formers are known which are provided with a MB unit or units of the type described above. With respect to these, reference is made to the following Finnish Patent Application Nos.: 884109, 885608, 904489, 905447, 920228, 920863, 924289, 930927, 931950, 931951, 931952, 932265, 932793, and 934999. FI 885608, FI 932265, FI 932793 and FI 934999 correspond to U.S. patent application Ser. Nos. 07/442,013, 08/246,176, 08/262,138 and 08/439,514, respectively, which are hereby incorporated by reference herein. Further, FI 904489 and FI 920228 correspond to U.S. Pat. Nos. 5,215,628 and 5,395,484, respectively, which are hereby incorporated by reference herein.

In the prior art roll-rib formers most closely related to the present invention, usually one forming-suction roll is employed which removes a considerable proportion, i.e., more than about 50%, of the flow quantity of the headbox before the pulp web is passed over the forming member that produces pressure pulses, such as a MB unit or a stationary forming shoe. In some prior art formers, after the pressure pulsation/forming member, a forming-suction roll is used, which is provided with high vacuum.

The latter formers involve the drawback that, when just one forming-suction roll is employed before the pressure pulsation/ forming member, the regulation of the vacuum level in the forming-suction roll has a strong effect on the face of the sheet only that is placed at the side of the forming-suction roll. Thus, the regulation of the vacuum in the forming-suction roll produces unequalsidedness in the sheet that is being formed, as will be explained below with reference to the accompanying FIG. 5A. Since the level of the vacuum in the forming roll also affects the formation of the web, it is generally not possible to achieve minimal unequalsidedness and good formation of a sheet with the same operation parameters.

OBJECTS AND SUMMARY OF THE INVENTION

Accordingly, it is an object of the present invention to provide a novel twin-wire former, in particular a gap former, which has a high web-running speed potential and with which the web that is produced has a reduced unequalsidedness but yet, good formation.

It is another object of the invention to provide a twin-wire former, in particular a gap former, for particularly high web speeds, which are typically from about 1600 m/min to about 2500 m/min. This speed range has not been attained by means of the prior art formers.

In view of achieving the objects stated above and others, the former in accordance with the invention comprises as a combination, a first forming-suction roll which is arranged in the area of the forming gap and a second forming-suction roll which is arranged inside the loop of the wire opposite to the wire inside whose loop the first forming roll is placed. The first and second forming-suction rolls have suction zones over which the twin-wire zone is curved on certain sectors thereof. In the suction zones, the vacuum levels are arranged adjustable independently from and preferably relative to one another so as to minimize the unequalsidedness of the web. After the second forming-suction roll in the running direction of the web, there is a pressure pulsation unit in the twin-wire zone. The regulation of the level of suction in the suction zones in the first and second forming-suction rolls is adjusted according to a predetermined relationship in order to provide for symmetrical dewatering of the web and avoid unequalsidedness of the web.

According to the invention, when a second forming-suction roll is used inside the wire loop opposite to the wire loop of the first forming-suction roll, the relationship between the vacuum levels in these forming-suction rolls can be selected independently from one another, yet relative to one another, to control the surface properties of both sides of the web. This aspect will be explained in greater detail below with reference to the accompanying Fig. B. Thus, the former in accordance with the present invention differs substantially and advantageously from formers in which only a single forming-suction roll is employed, in which formers, also at high speeds, the control of the properties of the opposite faces of the web independently from one another has not been possible.

By means of the magnitudes of the web-turning sectors of the forming-suction rolls used in the invention and by means of the control of the absolute levels of the vacuum in the suction zones placed on the sectors, it is possible to regulate the water-draining proportions of both forming-suction rolls so that a paper can be produced whose both faces are equal in respect of the absorption of ink or oil. In this manner, the dry solids content of the web and its distribution in the z-direction can be kept in an optimal range when the web reaches the pressure pulsation unit, such as an MB unit.

Alternatively, the invention can be carried into effect so that the wire-contact sectors on both of the forming-suction rolls are made larger (with respect to prior art forming-suction rolls) so that they are substantially equally large as compared with one another, being of the size of a sector that is normally used in the prior art roll-rib formers in which there is only one forming-suction roll. Owing to the increased water-draining capacity thus achieved, the former can be made suitable for particularly high web-running speeds of from about 1600 m/min to about 2500 m/min, which has not been possible in the prior art formers in which there is only one forming suction roll with a large wire-contact sector. This advantage is obtained because, with two forming-suction rolls, the draining resistance in the twin-wire zone is developed more evenly, and the draining pressure can be increased further in the second forming-suction roll by selecting its diameter to be smaller than the diameter of the first roll since on the second forming roll, the draining resistance is higher than on the first one.

Furthermore, in the invention, by regulating the magnitude of the wire-contact sectors on both of the forming-suction rolls, the diameters of the forming rolls and the vacuum levels, independent of and/or relative to each other, it is possible to keep the dry solids content of the web at an optimal level as it reaches the pressure pulsation unit, such as the MB unit, also when the former is operating at considerably high web running speeds, even higher web running speeds when compared with the prior art formers. At the same time, the unequalsidedness and the formation of the web can be controlled independently from one another.

In the method in accordance with the invention, a pulp suspension layer or a pulp suspension jet is fed into a forming gap situated at a beginning of a twin-wire zone defined between first and second wires to form a web. The first and second wires and the web carried therebetween are passed over a curve sector of a first forming-suction roll arranged proximate to the forming gap inside a loop of the first wire. The first forming-suction roll has a suction zone in the curve sector. Thereafter, the first and second wires and the web carried therebetween are passed over a curve sector of a second forming-suction roll arranged inside a loop of the second wire. The second forming-suction roll has a suction zone in the curve sector. The level of suction in each of the suction zones in the first forming-suction roll and the suction zone in the second suction-forming roll is adjusted independent from and relative to one another. A pressure pulsation may also be directed at the web in the twin-wire zone after the second forming-suction roll in the running direction of the web.

In additional embodiments of the invention, the diameter of the first forming-suction roll is selected in a range from about 0.9 m to about 1.7 m as a function of the paper grade produced and on the web speeds. Also as a function of the paper grade produced and on the web speeds, the curve sector of the twin-wire zone on the first forming-suction roll may be selected in a range from about 0° to about 45°, the diameter of the second forming-suction roll may be selected in a range from about 0.9 m to about 1.7 m, and the curve sector of said twin-wire zone on the second forming-suction roll may be selected in a range from about 15° to about 45°.

In the following, the invention and the prior art and the physical phenomena that constitute the starting point of the invention will be described in more detail with reference to the figures in the accompanying drawings. However, the invention is by no means strictly confined to the details in the illustrated embodiments.

BRIEF DESCRIPTION OF THE DRAWINGS

The following drawings are illustrative of embodiments of the invention and are not meant to limit the scope of the invention as encompassed by the claims.

Figure 5A:
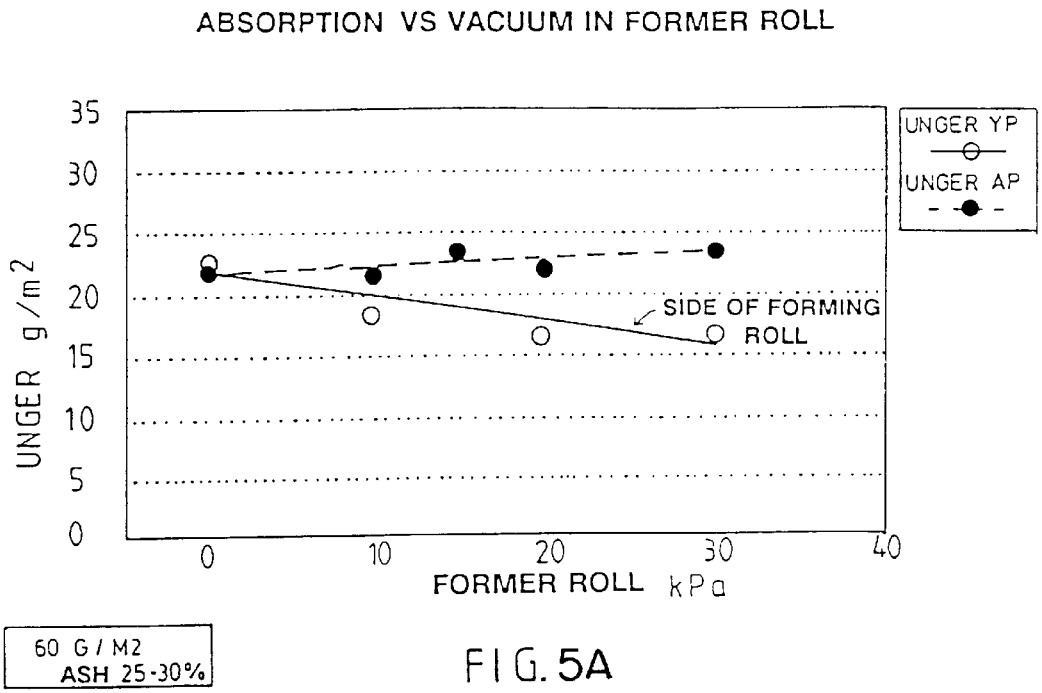

The diagram in FIG. 5A illustrates the effect of the vacuum in the forming-suction roll on the unequalsidedness of the web in prior art roll-rib formers in which there is one forming-suction roll.

Figure 5B:
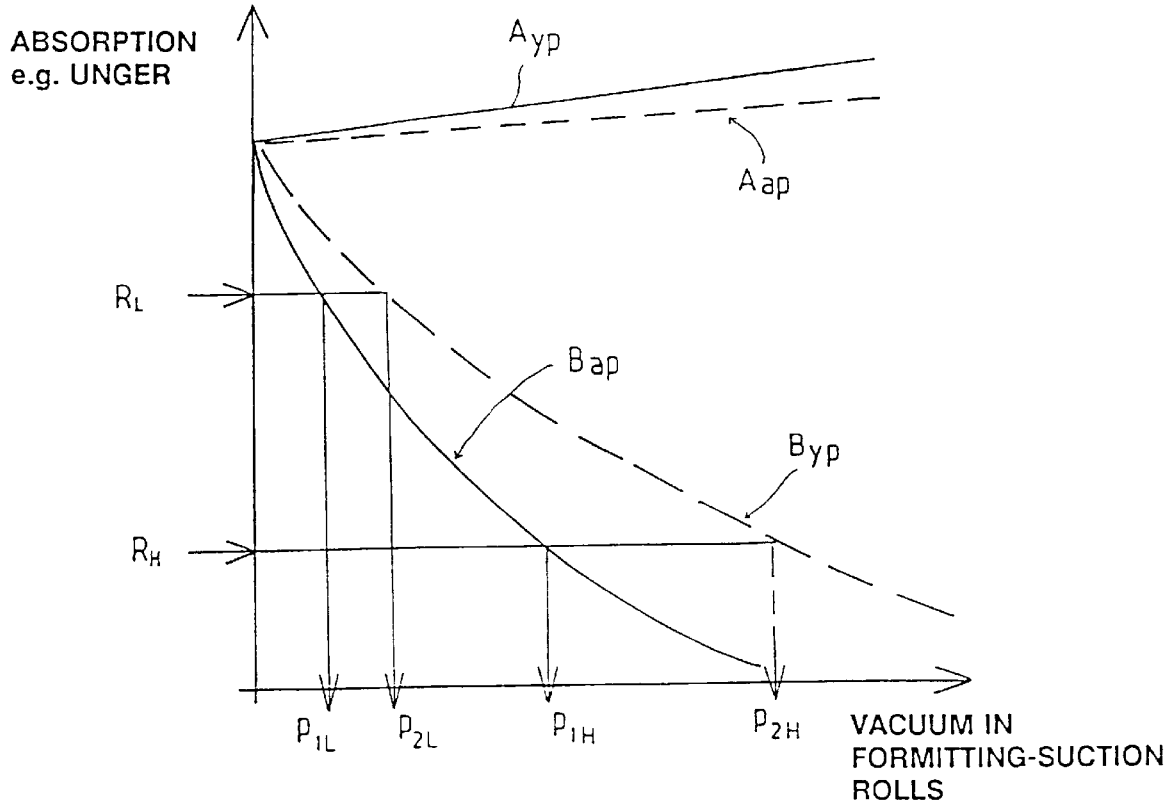

FIG. 5B illustrates the regulation of the vacuum levels in the forming-suction rolls in a former which comprises two forming-suction rolls in accordance with the invention, so as to achieve a minimal unequalsidedness of the web at different vacuum levels.

DETAILED DESCRIPTION OF THE INVENTION

Figure 1:
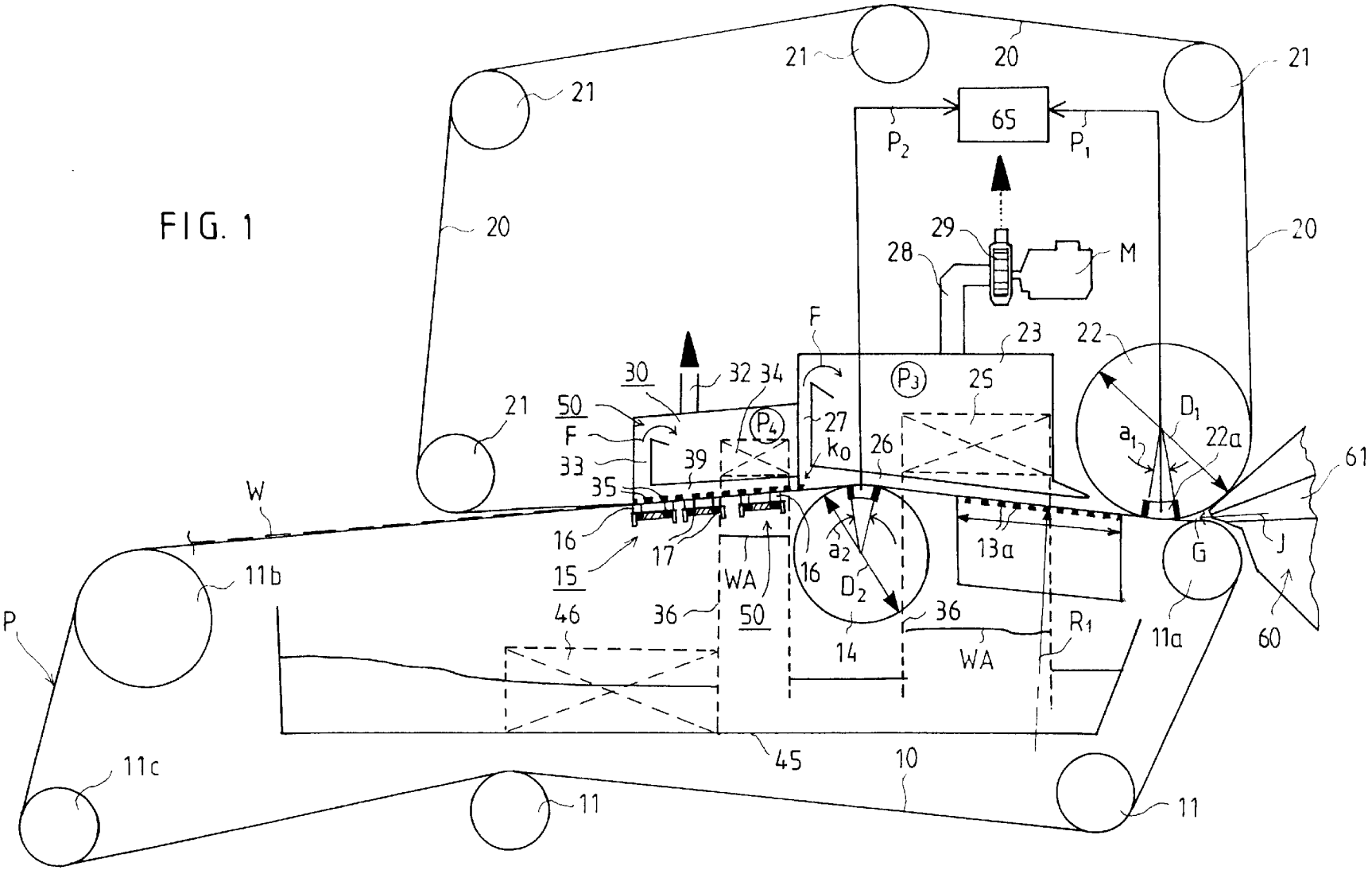
FIG. 1 is a schematic side view of a first embodiment of the invention.
Figure 2:
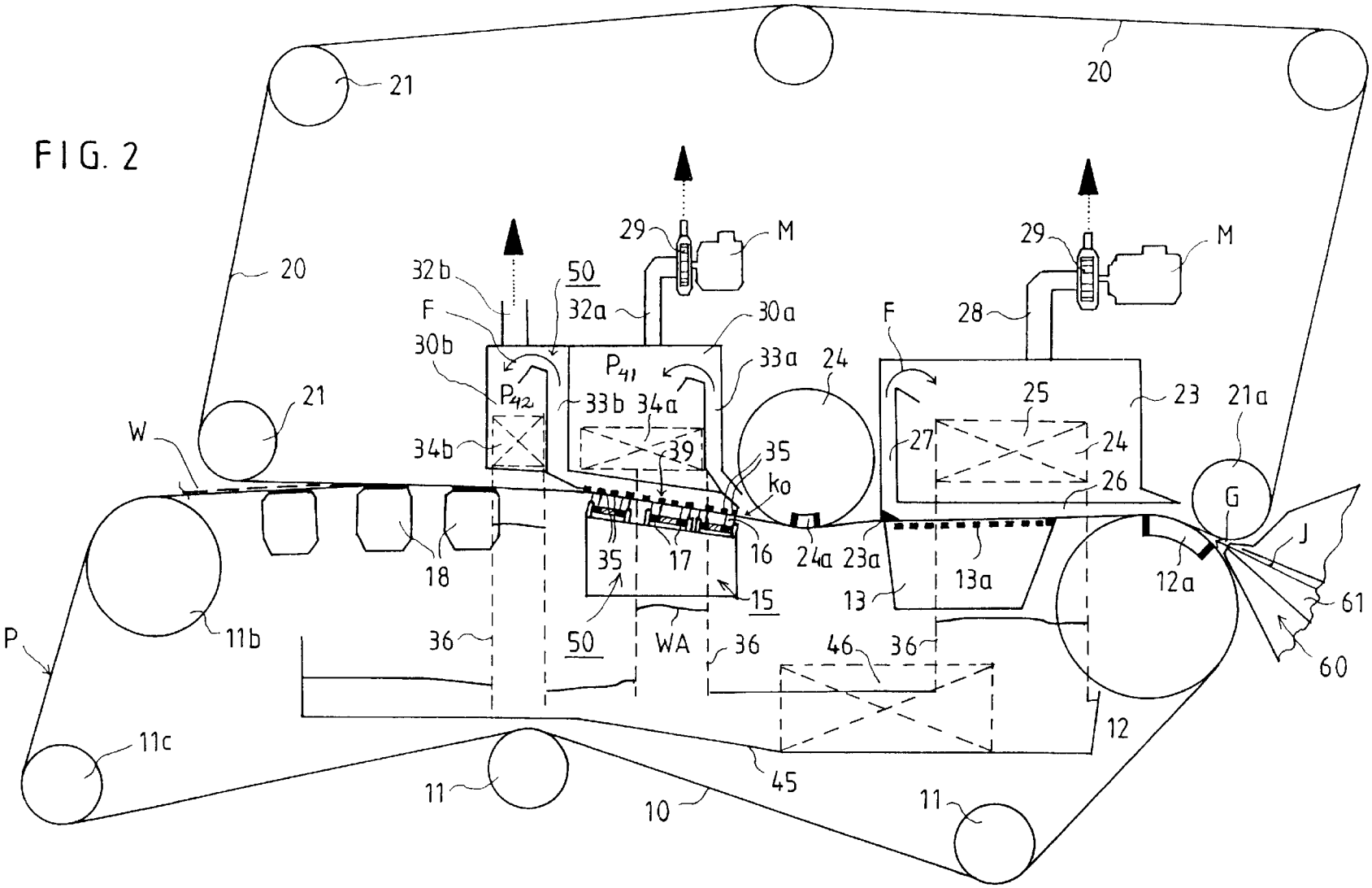
FIG. 2 is a schematic side view of a second embodiment of the invention.
Figure 3:
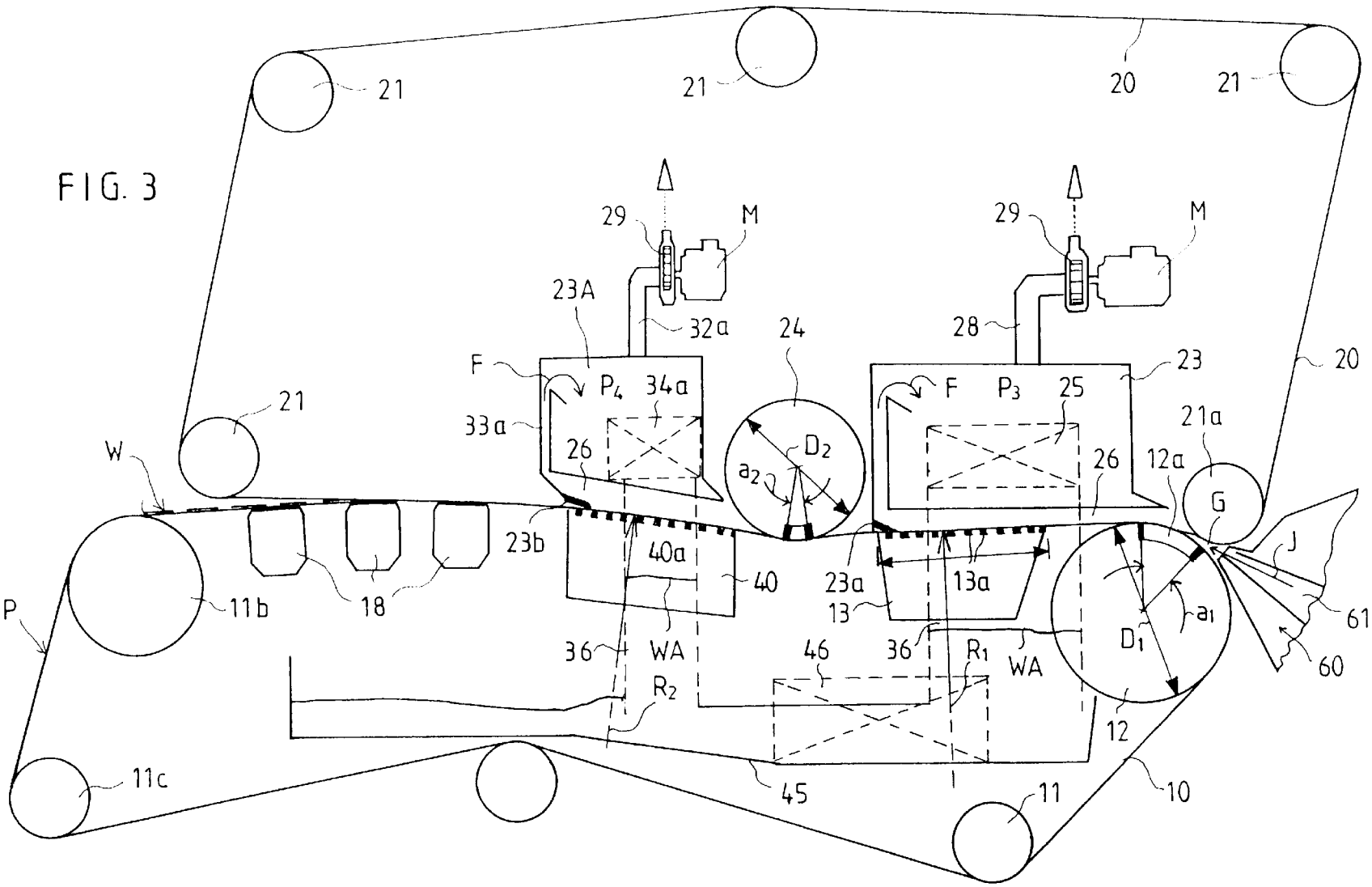
FIG. 3 is a schematic side view of a third embodiment of the invention, in which an MB unit is not employed.

Referring to the accompanying drawings wherein the same reference numerals refer to the same or similar elements, the paper machine formers shown in FIGS. 1–4 comprise a lower forming wire 10 which is guided in a loop by guide rolls 11, 11*b*, 11*c*, a second forming-suction roll 14 and a breast roll 11*a* (FIGS. 1 and 4) or by guide rolls 11, 11*b*, 11*c* and a first forming-suction roll 12 (FIGS. 2 and 3). The formers comprise an upper forming wire 20 which is guided in a loop by guide rolls 21 and a first forming roll 22 (FIGS. 1 and 4) or by guide rolls 21, a breast roll 21*a* and a second forming roll 24 (FIGS. 2 and 3). A pulp suspension jet J is fed into a forming gap G defined by the forming wires 10 and 20 through a discharge duct 61 of a headbox 60 of the paper machine. The twin-wire zone starts directly after the gap G.

Figure 4:
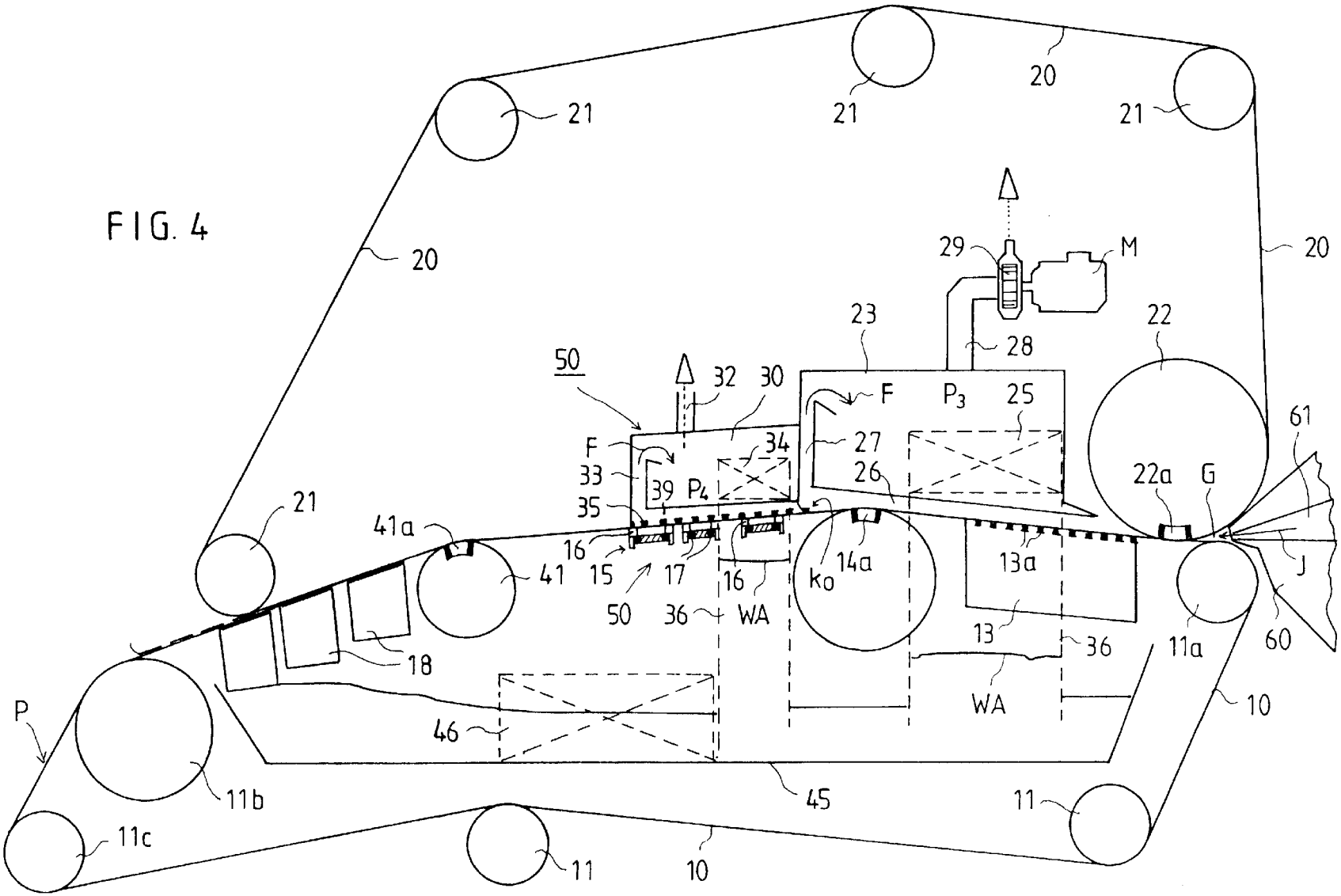
FIG. 4 is a schematic side view of a fourth embodiment of the invention.

As shown in FIGS. 1 and 4, at the beginning of the twin-wire zone, inside the loop of the upper wire 20, there is the first forming-suction roll 22 which includes a suction zone 22*a*. The level of the vacuum $P_1$ in the suction zone 22*a* can be regulated by means of suction devices 65 in themselves known. In FIGS. 1 and 4, the forming gap G is defined from below by the lower wire 10 running over the breast roll 11*a*.

In FIGS. 2 and 3, the first forming-suction roll 12 is placed inside the loop of the lower wire 10, and the forming gap G is defined from above by the upper wire 20 which runs over the breast roll 21*a*.

The twin-wire zone is in contact with the first forming roll 12,22 over a sector a, of the first forming roll 12,22, which is followed by a run of the wires 10,20 over a stationary forming shoe 13 arranged inside the loop of the lower wire 10. The forming shoe 13 is provided with a ribbed deck 13*a* which has a large curve radius R1 whose center of curvature is placed at the side of the lower wire 10. The curve radius R1 is selected preferably in the range from about 3 m to about 8 m. Facing the forming shoe 13, inside the loop of the upper wire 20, there is a suction-deflector box 23 at whose rear edge there is a deflector rib 23*a* operating against the inner face of the upper wire 20. The water draining from the web W through the upper wire 20 at the top and front side of the forming shoe 13 is passed through a space 26 situated below the box 23 and through a suction-deflector duct 27, in the direction of arrow F, into the box 23. From box 23, the water is drained through a duct 25 connected with a suction leg 36. In the box 23, a suitable vacuum level $p_3$ is maintained by means of a blower 29 driven by a motor M. The blower 29 communicates through a duct 28 with the box 23, and the air is removed from it in the direction of the arrow above the blower 29.

As shown in FIGS. 1 and 4, the second forming-suction roll 14 is arranged underneath the rear end of the suction-deflector box 23 inside the loop of the lower wire 10. Forming-suction roll 14 includes a suction sector 14*a*. The suction sector 14*a* communicates with a vacuum source 65 so that the vacuum level $p_2$ in the suction sector 14*a* is adjustable. As shown in FIGS. 2 and 3, the second forming-suction roll 24 is placed inside the loop of the upper wire 20 after the suction-deflector box 23. The twin-wire zone is curved by means of the second forming-suction roll 14,24 over a sector $a_2$.

In the embodiments in FIGS. 1, 2 and 4, the second forming-suction roll 14,24 is followed in the twin-wire zone by an MB unit 50, which is also arranged in the loop of the upper wire 20. The MB unit 50 shown in FIGS. 1 and 4 immediately follows, and is preferably directly connected or attached to, the preceding suction-deflector box 23. The MB unit 50 comprises a dewatering box 30 which communicates with the suction leg 36 through a duct 34, the water level in the suction leg 36 being denoted by WA. Underneath the dewatering box 30, there is a fixed set of support ribs 35. In FIGS. 1 and 4, a loading unit 15 of the MB unit 50 operates against the set of ribs 35, i.e., arranged in the loop of the lower wire 10, and comprises loading ribs 16 loaded by means of pressure medium passed into pressure hoses 17 or by means of an equivalent power arrangement. The loading ribs 16 are placed facing the gaps between the support ribs 35. Above the set of support ribs 35, a space 39 is defined through which the water drained through the upper wire 20 is passed while aided by the negative pressure $p_4$ in the box 30, and then flows through a duct 33 in the direction of the arrow F into the box 30. The box 30 communicates through a duct 32 with a vacuum source (not shown).

FIG. 2 shows an MB unit in which there are two successive dewatering chambers 30*a* and 30*b*. The first chamber 30*a* is a suction-deflector chamber having a suction duct 33*a* opens above the first one of the fixed support ribs 35 in the running direction of the web. The first chamber 30*a* communicates through a duct 32*a* with the blower 29 driven by the motor M. From the chamber 30*a*, the water is drained through a duct 34*a* into the suction leg 36. Underneath the first suction chamber 30*a*, there is a loading unit 15 similar to that described above, in which there are loading ribs 16 loaded by means of pressure passed into the hoses 17 and placed facing the gaps between the fixed support ribs 35. Through the gaps between the support ribs 35, the water is drained through the upper wire 20 through the space 39 into the duct 33*b* and from there further, in the direction of the arrow F, into the second suction chamber 30*b*. The second suction chamber 30*b* communicates through a duct 32*b* with a vacuum source (not shown). From the chamber 30*b*, the water is drained through a duct 34*b* communicating with the suction leg 36. The vacuum levels $P_{41}$ and $P_{42}$ present in each of the chambers 30*a* and 30*b* can be regulated independently from one another. Through the suction-deflector duct 33*a* of the first chamber 30*a*, primarily the water is drained that is separated from the web W directly after the second suction roll 24 which is placed after the suction-deflector box 23 in the running direction of the web.

In the embodiment shown in FIG. 3, after the suction roll 24, there is no MB unit. Rather, at this location, inside the upper-wire loop 20, there is a suction-deflector chamber 23A. Underneath this chamber 23A, inside the lower-wire loop 10, there is a suction box 40 including a ribbed deck 40*a* which either is straight or has a very large curve radius R2. At the rear edge of the ribbed deck 40*a*, there is a deflector rib 23*b* which defines a space 26 underneath the chamber 23A. Through this space 26, the water drained through the upper wire 20 flows in the direction of the arrow F into the chamber 23A and from there further through a duct 34*a* into the suction leg 36. The chamber 23A communicates through a duct 32*a* with a blower 29 driven by a motor M so as to maintain an adjustable vacuum level $p_4$ inside the chamber 23A.

Referring now back to FIG. 1, after the MB unit 50, the paper web W follows the lower wire 10, from which it is separated at a pick-up point P and is transferred to the press section (not shown). As shown in FIGS. 2 and 3, after the MB unit and the suction-deflector chamber 23A, inside the lower-wire loop 10, there are suction flatboxes 18. In FIG. 4, after the MB unit 50, inside the loop of the lower wire 10, there is a third forming-suction roll 41 which includes a suction sector 41*a*. On suction sector 41*a*, the twin-wire zone is curved downwards, after which the web W is separated from the upper wire 20 and transferred over the suction flatboxes 18 to the pick-up point P. In the illustrated embodiments, a water collecting basin 45 is arranged inside the loop of the lower wire 10 and is connected with the wire-pit (not shown) through a drain duct 46.

As to the measures of the forming rolls 12,22,14,24 in the former in accordance with the invention, it should be stated that the diameter $D_1$ of the first forming roll 12,22 is preferably selected in the range of from about 0.9 m to about 1.7 m. The contact sector $a_1$ of the wires on the first forming roll is selected in the range of from about 0° to about 45°. When the sector a, equals 0°, this means that there is only a tangential contact between the wires and the first forming roll. The choice of the parameters $D_1$ and $a_1$ depends on the machine speed and on the paper grade that is produced. For example, for newsprint, the parameters are preferably $D_1$ is about 1.6 m and $a_1$ is about 25°. With other grades, the choice of parameters differs from the above.

The diameter $D_2$ of the second forming roll 14,24 is selected in the range of from about 0.9 m to about 1.7 m, and the sector of contact $a_2$ is from about 15° to about 45°. Moreover, the choice is made that $D_1>D_2$ in order that the dewatering pressure could be increased on the second forming-suction roll 14,24 because of the increased draining resistance of the web W. For newsprint, the parameters are preferably selected so that $D_2$ equals about 1.23 m, and $a_2$ equals about 20°. The forming shoe 13 placed between the first and the second forming-suction roll is kept as short as possible. The length L in the machine direction of the ribbed deck 13*a* is selected to be about 300 mm when $R_1$ equals about 5 m. The curve radius $R_1$ of the ribbed deck 13*a* is selected in the range of from about 3 m to about 8 m.

The vacuum levels $P_1$ and $P_2$ in the suction zones of the forming-suction rolls 12,22,14,24 are arranged adjustable, and the vacuum level $P_1$ is typically selected in the range of from about 0 kPa to about 25 kPa and the vacuum level $P_2$ is typically selected in the range of from about 0 kPa to about 35 kPa.

In the following, the drawbacks in the prior art, the physical background of the invention, and the mode of effect of the invention will be described with reference to the diagrams in FIGS. 5A and 5B.

The diagram in FIG. 5A illustrates the absorptions of oil (grams per square meter), measured with the UNGER test, at the opposite sides of the web (YP=top side, AP=bottom side) as a function of the vacuum (level of negative pressure) in the forming-suction roll in a prior art roll-rib former in which there is only one forming-suction roll. The Unger test is a known test and is described in detail in paper SCAN-P 37:77 by the Scandinavian Pulp, Paper and Board Testing Committee accepted for publication in December 1976. Briefly, the Unger test or Cobb-Unger test determines oil absorbency of paper and board which is the mass of castor oil absorbed per unit area by one side of a paper or board under specified conditions which include the duration of contact between the castor and the side of the paper or board. The absorbency is then determined by weighing conditioned test pieces with known dimensions before and after exposure to the castor oil.

In FIG. 5A, the side facing the forming roll is the top side of the web that is produced, i.e., that side contacting the upper wire. It is seen from FIG. 5A that the unequalsidedness of the web increases in a substantially linear manner when the vacuum level in the forming-suction roll is increased, which results in the drawbacks discussed above. This is caused by the increased amount of water removed from the top side of the web through the upper wire upon an increase in the vacuum level in the forming-suction roll while the amount of water being removed from the bottom side of the web is being reduced. Also, as the vacuum level increases, the distribution of fillers in the web in the thickness direction, i.e., the z-direction, changes. At low vacuum levels, there is more filler in the bottom side or surface, that surface which is not directly opposite the forming-suction roll whereas there is more filler in the upper side at high vacuum levels, with the equilibrium being somewhere in between.

The relationship between the amount of filler in the top and bottom sides of the web and the oil absorbency as determined by the Unger test is as follows. At low vacuum levels with less filler in the top side, there is greater oil absorption thereat (see the beginning of the lines in FIG. 5A wherein the line representing the absorbency of the top side YP is above the line representing the oil absorbency of the bottom side AP). At some equilibrium vacuum level, the filler contents are equal and thus the oil absorbency is also equal. At high vacuum levels, the bottom side has less filler than the top side and consequently greater oil absorption. Thus, by controlling the drainage split from the top and bottom sides of the web, the amount of filler that remains in the web near the surface of the top and bottom sides is controlled. This amount of filler determines the oil absorbency. The absorbency of oil is the relevant measure of printing two-sidedness since oil is generally used as the ink solvent.

In light of the foregoing explanation, the diagram in FIG. 5B illustrates the mode of effect of the invention. FIG. 5B illustrates the absorption of oil (e.g., as determined by the Unger test) as a function of the vacuum (level of negative pressure) in the forming rolls 12,22,14,24. The graph $A_{yp}$ drawn with the solid line shows the absorption at the top side of the sheet in relation to the vacuum in the forming roll placed underneath, and correspondingly the graph $A_{ap}$ drawn with the dashed line shows the absorption at the bottom side of the sheet in relation to the vacuum in the upper former roll. From the graphs $A_{yp}$ and $A_{ap}$ in the figure, it comes out that the absorption at the opposite side of the sheet, opposite in relation to the forming-suction roll, is in practice substantially independent from the vacuum level in the forming-suction roll. The graph $B_{ap}$ in FIG. 5B illustrates the dependence of the absorption at the bottom side of the sheet as a function of the vacuum level in the forming-suction roll placed at the same side, i.e., at the bottom side. In a corresponding manner, the graph $B_{yp}$ illustrates the absorption at the top side of the sheet as a function of the vacuum level in the forming-suction roll at the same side, i.e., at the top side. If the aim is to avoid unequalsidedness of the sheet, i.e., the ratio of the absorptions at the top and bottom sides of the sheet is about 1, in such a case, at high web speeds or when otherwise high vacuum levels are used in the forming-suction rolls, in the horizontal plane indicated by the arrow $R_H$ the vacuum levels $P_{2H}$ and $P_{1H}$ of the forming-suction rolls 12,22,14,24 are selected. When low vacuum levels are used, in the horizontal plane indicated by the arrow $R_L$ the vacuum levels $P_{2L}$ and $P_{1L}$ of the forming-suction rolls 12,22,14,24 are selected. In this manner, according to a predetermined relationship between the levels of suction in each of the first and second forming-suction rolls and the drying and/or formation of the web and the control thereof based on the relationship, unequalsidedness of the web can be avoided at all available vacuum levels and even at high web speeds.

The examples provided above are not meant to be exclusive. Many other variations of the present invention would be obvious to those skilled in the art, and are contemplated to be within the scope of the appended claims. For example, the inlet of the former is not limited to a forming gap wherein a forming-suction roll is situated proximate thereto.

I claim:

1. In a twin-wire former of a paper machine, including a first covering, upper wire, a second carrying, lower wire and guide means for guiding said first covering, upper wire and said second carrying, lower wire in a substantially horizontal direction to define a substantially horizontal twin-wire zone therebetween in which a web runs and such that said second wire runs below said first wire, a pulp suspension layer or a pulp suspension jet being fed into an inlet or forming gap situated at a beginning of said twin-wire zone between said first and second wires to form the web, the improvement comprising a first forming-suction roll arranged proximate to said forming gap inside a loop of said first wire, said first forming-suction roll having a first suction zone in a sector thereof over which said twin-wire zone curves, a second forming-suction roll arranged after said first forming-suction roll and inside a loop of said second wire, said second forming-suction roll having a second suction zone in a sector thereof over which said twin-wire zone curves, a forming member arranged inside the loop of said second wire between said first and second forming-suction rolls, means for adjusting the level of suction in said first suction zone and the level of suction in said second suction zone independent from and relative to one another, draining means arranged in a loop of said first wire for draining water removed from the web through said first wire, said draining means being structured and arranged to remove water from a space above said second forming-suction roll extending from a location before said second forming-suction roll to a location after said second forming-suction roll, said draining means comprising a suction-deflector box extending from a location before said second forming-suction roll to a location after said second forming-suction roll and arranged in opposed, spaced relationship to said first wire to thereby define said space from which water is removed, said suction-deflector box extending over at least a part of said forming member and being structured and arranged to apply suction to said space from which water is removed, and a pressure pulsation device arranged in said twin-wire zone after said second forming-suction roll in the running direction of the web.

2. The former of claim 1, wherein said forming member is stationary.

3. The former of claim 2, wherein said forming member is a forming shoe having a curved ribbed deck.

4. The former of claim 3, wherein said suction-deflector box is arranged at least partially opposite to said ribbed deck, said suction-deflector box having a trailing side in the running direction of the web and comprising a deflector rib arranged at said trailing side, a suction-deflector duct having an opening situated above said deflector rib, a dewatering chamber communicating with said suction-deflector duct, and means for coupling said dewatering chamber to a vacuum source to thereby enable the application of suction to said space.

5. The former of claim 1, wherein said pressure pulsation device comprises an MB unit comprising a set of ribs arranged in a loop of each of said first and second wires, said sets of ribs being loaded against one another, at least one suction chamber arranged in a loop of said first wire and means for coupling said at least one suction chamber to a vacuum source.

6. The former of claim 1, wherein said pressure pulsation device comprises a suction-deflector chamber arranged inside a loop of said first wire, a deflector rib operating against an inner face of said first wire, a suction-deflector duct having an opening situated above said deflector rib and leading to said suction-deflector chamber, means for coupling said suction-deflector chamber to a vacuum source, and a stationary set of ribs arranged opposite said suction-deflector chamber inside a loop of said second wire.

7. The former of claim 6, wherein said stationary set of ribs has a large radius of curvature and guides said twin-wire zone in a curved path.

8. The former of claim 6, wherein said suction-deflector rib is arranged opposite a rib of said stationary set of ribs situated at a rear of said stationary set of ribs in the running direction of the web.

9. The former of claim 1, wherein said pressure pulsation device comprises an MB unit comprising a dewatering chamber arranged inside a loop of said first wire, a stationary set of support ribs fixed in a position below said dewatering chamber, a set of loading ribs arranged inside a loop of said second wire and operating against said set of support ribs, said set of loading ribs comprising loading hoses and being loaded by means of pressure directed into said loading hoses.

10. The former of claim 1, wherein the diameter of said first forming-suction roll is in a range from about 0.9 m to about 1.7 m, the curve sector of said twin-wire zone on said first forming-suction roll is in a range from about 0° to about 45°, the diameter of said second forming-suction roll is in a range from about 0.9 m to about 1.7 m, and the curve sector of said twin-wire zone on said second forming-suction roll is in a range from about 15° to about 45°.

11. The former of claim 10, wherein the diameter of said first forming-suction roll is about 1.6 m, the curve sector of said twin-wire zone on said first forming-suction roll is about 25°, the diameter of said second forming-suction roll is about 1.2 m, and the curve sector of said twin-wire zone on said second forming-suction roll is about 20°.

12. The former of claim 3, wherein said ribbed deck has a radius of curvature having a curve center at the side of the loop of said second wire and being in a range from about 3 m to about 8 m.

13. A method for dewatering a web in a twin-wire former of a paper machine to minimize unequalsidedness of the web, comprising the steps of:

carrying the web between a first covering, upper wire and a second carrying, lower wire, guiding the first and second wires in a substantially horizontal direction to define a substantially horizontal twin-wire zone in which said second wire runs below said first wire, passing said first and second wires and the web carried therebetween over a curve sector of a first forming-suction roll arranged inside a loop of said first wire, said first forming-suction roll having a first suction zone in said curve sector, passing said first and second wires over a forming member arranged inside a loop of said second wire after said first forming-suction roll, thereafter passing said first and second wires and the web carried therebetween over a curve sector of a second forming-suction roll arranged inside the loop of said second wire, said second forming-suction roll having a second suction zone in said curve sector, draining water removed from the web from a space above said second forming-suction roll extending from a location before said second forming-suction roll to a location after said second forming-suction roll, said water draining step comprising the steps of arranging a suction-deflector box in the loop of said first wire extending from a location before said second forming-suction roll to a location after said second forming-suction roll and over at least a part of said forming member, said suction-deflector box being in opposed, spaced relationship to said first wire to thereby define said space from which water is removed, and applying suction to said space from said suction-deflector box, and adjusting the level of suction in said first suction zone and the level of suction in said second suction zone independent from and relative to one another.

14. The method of claim 13, further comprising the step of selecting the diameter of said first forming-suction roll in a range from about 0.9 m to about 1.7 m as a function of the paper grade produced and on the web speeds.

15. The method of claim 13, further comprising the step of selecting the curve sector of said twin-wire zone on said first forming-suction roll in a range from about 0° to about 45° as a function of the paper grade produced and on the web speeds.

16. The method of claim 13, further comprising the step of selecting the diameter of said second forming-suction roll in a range from about 0.9 m to about 1.7 m as a function of the paper grade produced and on the web speeds.

17. The method of claim 13, further comprising the step of selecting the curve sector of said twin-wire zone on said second forming-suction roll in a range from about 15° to about 45° as a function of the paper grade produced and on the web speeds.

18. The method of claim 13, further comprising the step of directing a pressure pulsation at the web in said twin-wire zone after said second forming-suction roll in the running direction of the web.

19. The method of claim 13, further comprising the step of feeding a pulp suspension layer or a pulp suspension jet into an inlet or forming gap situated at a beginning of the twin-wire zone defined between said first and second wires to form the web, said first forming-suction roll being arranged proximate to said forming gap.

* * * * *